United States Patent [19]

Takahashi et al.

[11] Patent Number: 4,883,741

[45] Date of Patent: Nov. 28, 1989

[54] INFORMATION RECORDING MEDIUM

[75] Inventors: Younosuke Takahashi; Takayuki Kuriyama, both of Fujinomiya, Japan

[73] Assignee: Fuji Photo Film Co., Ltd., Minami-Ashigari, Japan

[21] Appl. No.: 90,549

[22] Filed: Aug. 28, 1987

[30] Foreign Application Priority Data

Aug. 28, 1986 [JP] Japan ..... 61-203483

[51] Int. Cl.[4] ..... G03C 5/16

[52] U.S. Cl. ..... 430/270; 430/298; 430/495; 430/945; 346/135.1

[58] Field of Search ..... 430/945, 495, 270, 298; 346/135.1

[56] References Cited

U.S. PATENT DOCUMENTS 4,328,303 5/1982 Ronn et al. ..... 430/290

4,713,314 12/1987 Namba et al. ..... 430/945

4,720,449 1/1988 Borror et al. ..... 430/945

FOREIGN PATENT DOCUMENTS 0125617 11/1984 European Pat. Off. .

*Primary Examiner*—Paul R. Michl

*Assistant Examiner*—Mark R. Buscher

*Attorney, Agent, or Firm*—Gerald J. Ferguson, Jr.

[57] ABSTRACT

A novel information recording medium comprising a substrate and a recording layer for writing information by means of laser beam which is provided on the substrate is disclosed. The recording layer contains an organic metal complex compound and a sensitizing agent for laser beam. Alternatively, the recording layer contains an organic metal complex compound and this recording layer is arranged in contact with a layer of a sensitizing agent for laser beam.

9 Claims, 1 Drawing Sheet

INFORMATION RECORDING MEDIUM

BACKGROUND OF THE INVENTION

1. Field of the Invention

The present invention relates to an information recording medium for writing (i.e., recording) information by means of laser beam.

2. Description of Prior Art

Information recording media for recording and/or reproducing information by the use of laser beam have been developed in recent years and are put to practical use. Such recording media have been widely utilized in various fields, for example, as an optical disc such as video disc and audio disc as well as disc memory for large-capacity computer and large-capacity static image file, micro-image recording medium, ultramicro-image recording medium, micro-facsimile, and optical card.

The conventional optical information recording medium basically comprises a transparent substrate of a plastic or glass material and a recording layer provided on the substrate, and the recording layer is generally composed of a metal such as Bi, Sn, In or Te, and a semi-metal. Between the substrate and the recording layer, an undercoating layer or an intermediate layer made of a polymer material is generally provided from the viewpoints of improving surface smoothness of the substrate and adhesion between the substrate and the recording layer and/or increasing sensitivity of the resulting medium. Writing (i.e., recording) of information on the recording medium can be conducted, for example, by irradiating the medium with a laser beam. Under irradiation with the laser beam, the irradiated area of the recording layer of the recording medium absorbs energy of the beam and rise in temperature locally occurs, and as a result a chemical or physical change is caused to alter (or change) optical characteristics of the recording layer in the irradiated area, whereby the recording of information can be made. Reading of the information from the recording medium is also conducted by irradiating the medium with laser beam. The information can be reproduced by detecting reflected light or transmitted light corresponding to the change in the optical characteristics of the recording layer.

Recently, an optical disc having an air-sandwich structure for protecting the recording layer has been proposed. The optical disc of air-sandwich structure comprises two disc-shaped substrates, a recording layer provided on at least one of the substrates and two ring-shaped spacers (inner spacer and outer spacer), said two substrates interposing the recording layer being combined with each other in such a manner that a closed space is formed by the two substrates and the two spacers. In such recording medium, the recording layer is kept from direct exposure to an outer air, and recording or reproduction of information is carried out by applying light of the laser beam to the recording layer through the substrate, whereby the recording layer is generally kept from physical or chemical damage. Further, the surface of the recording layer can be kept from deposition of dust which likely causes troubles in the recording or reproducing procedure.

In the above-mentioned conventional information recording medium, the recording layer made of a metal or a semi-metal can be generally formed on the substrate of plastic or glass material by a method such as a deposition (metallizing) method or a sputtering method.

The deposition method is advantageous for providing a recording layer, but has a problem of preservability as far as a material such as Te having high sensitivity to laser and capable of forming a film by deposition is concerned. Further, the method needs an expensive vacuum apparatus and high vacuum technique, and furthermore the method requires a long period of time for forming a recording layer.

The sputtering method is more advantageous than the deposition method in the formation of a recording layer, but it is difficult to precisely determine the thickness of the recording layer and an expensive apparatus is required in the method.

An information recording medium using a dye as a recording material is also known. In this case, a dye is generally dissolved or dispersed in an appropriate solvent to prepare a solution, and the solution is coated over a substrate to form a recording layer on the substrate. This coating method using the coating solution to form a recording layer is excellent in mass production and provides a recording medium at low cost. However, the recording layer prepared by the coating method is inferior to the above-mentioned recording layer made of metal or semi-metal by the deposition or sputtering method in resistance to light or heat.

Accordingly, an information recording medium having the conventional recording layer formed by the deposition method, sputtering method or coating method is desired to be improved in various properties such as endurance, mass productivity and recording sensitivity.

SUMMARY OF THE INVENTION

It is an object of the present invention to provide a novel information recording medium which is improved in recording sensitivity and storing property.

There is provided by the invention an information recording medium comprising a substrate and a recording layer for writing information by means of laser beam which is provided on the substrate, wherein said recording layer contains an organic metal complex compound and a sensitizing agent for laser beam.

There is further provided by the present invention an information recording medium comprising a substrate and a recording layer for writing information by means of laser beam which is provided on the substrate, wherein said recording layer contains an organic metal complex compound and a layer of a sensitizing agent for laser beam is provided in contact with the recording layer.

The information recording medium of the invention employs an organic complex compound as a recording material, and information can be recorded on the medium based on a system of recording information utilizing deposition (precipitation) of a metal component by decomposition of the organic metal complex compound under heating. However, the organic metal complex compound itself does not substantially absorb laser beam. Accordingly, in the system of the invention, the organic metal complex compound is brought into contact with a sensitizing agent for laser beam (i.e., laser beam sensitizing agent), and hence the information recording medium of the invention shows excellent properties in practical use.

In the information recording medium of the invention, the organic metal complex compound or both of the organic metal complex compound and the laser beam sensitizing agent are preferably contained in the recording layer in the dispersed form in a polymer.

Recording (i.e., writing) of information on the information recording medium of the invention can be carried out by irradiating the recording layer with laser beam in the same manner as for the conventional information recording medium such as an optical disc.

In the information recording medium of the present invention, the recording layer is obtained by coating a solution containing an organic metal complex compound over a substrate made of glass, plastic, etc., and hence the recording layer is excellent in mass productivity and storing property.

Further, the organic metal complex compound used as a recording material in the recording medium of the present invention shows recording sensitivity of prominently high level when employed in combination with a laser beam sensitizing agent.

Accordingly, the information recording medium of the invention is highly improved in sensitivity, mass productivity and storing property.

DETAILED DESCRIPTION OF THE INVENTION

The information recording medium of the present invention is now described in detail referring to the attached drawings.

As the embodiment of the constitution of the information recording medium according to the invention, there can be mentioned an embodiment in which a recording layer containing an organic metal complex compound and a sensitizing agent for laser beam is provided on a substrate (referred to hereinafter as "the first embodiment").

Figure 1:
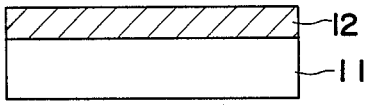
FIGS. 1 through 7 are sectional views showing various embodiments of the constitution of an information recording medium according to the present invention.
Figure 2:
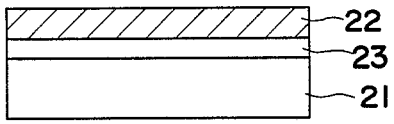
Figure 3:
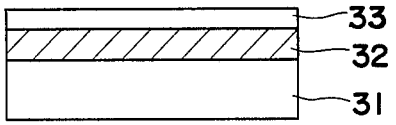

Examples of the first embodiment are shown in FIGS. 1, 2 and 3.

In FIG. 1, on a substrate 11 is arranged a recording layer 12.

In FIG. 2, on a substrate 21 is arranged a recording layer 22 via a reflecting layer for laser beam (a laser beam reflecting layer) 23.

The laser beam reflecting layer serves to enhance a sensitivity of the recording layer and to increase S/N ratio in the read-out procedure, and may be arranged on any surface of the upper and the lower surfaces of the recording layer provided that the reflecting layer is brought into direct or indirect contact with the recording layer.

That is, as shown in FIG. 3, a laser beam reflecting layer 33 is arranged on a recording layer 32 which is provided on a substrate 31, namely on the opposite side of the substrate.

In the above-mentioned indirect contact of the laser beam-reflecting layer with the recording layer means, for example, a case that a thin layer such as an adhesive layer is arranged between the reflecting layer and the recording layer.

As another embodiment of the constitution of the information recording medium according to the invention, there can be mentioned an embodiment in which a recording layer containing an organic metal complex compound and a layer of a sensitizing agent for laser beam are provided independently on a substrate (referred to hereinafter as "the second embodiment").

Examples of the second embodiment are shown in FIGS. 4, 5, 6 and 7.

Figure 4:
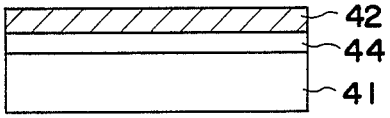

In FIG. 4, on a substrate 41 is arranged a recording layer 42 via a layer of a sensitizing agent for laser beam (a sensitizing agent layer for laser beam) 44.

The sensitizing agent layer for laser beam may be provided on any surface of the upper and the lower surfaces of the recording layer provided that the sensitizing agent layer for laser beam is brought into contact with the recording layer.

Figure 5:
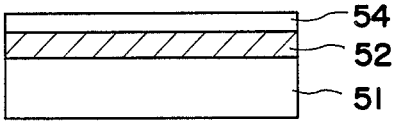

In FIG. 5, on a substrate 51 is arranged a recording layer 52 on which a sensitizing agent layer for laser beam 54 is provided.

Figure 6:
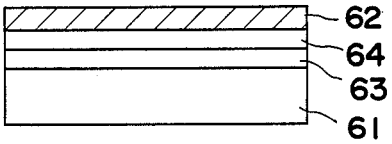
Figure 7:
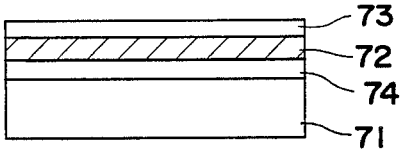

FIGS. 6 and 7 show other examples of the second embodiment in which laser beam reflecting layer is further provided.

In FIG. 6, on a substrate 61 is arranged a laser beam reflecting layer 63 on which a sensitizing agent layer for laser beam 64 and a recording layer 62 are laminated (superposed) in this order.

In FIG. 7, on a substrate 71 is arranged a sensitizing agent layer for laser beam 74 and a recording layer 72 are laminated (superposed) in this order, and thereupon a laser beam reflecting layer 73 is provided.

As shown in the above-mentioned figures, there is no specific limitation on the constitution of layers such as a substrate, a recording layer, a sensitizing agent layer for laser beam and a laser beam reflecting layer in the information recording medium of the invention, as far as the constitution satisfies the conditions defined in claims of the invention. Further, a protective layer comprising an organic material or an inorganic material may be provided on the back surface of the substrate (i.e., surface not facing the recording layer) or the surface of the uppermost layer among the above-mentioned layers. Furthermore, the information recording medium of the invention may be provided with other additional layers which have been used or proposed in the conventional information recording medium such as an undercoating layer, an adhesive layer and a heat-insulating layer.

In the attached drawings, all of the functional layers such as a recording layer are arranged on one surface of the substrate, but those functional layers can be provided on both surfaces of the substrate.

The structure of the information recording medium according to the present invention is by no means limited to the above-mentioned one, and other structures can be also applied to the invention. For example, there can be included in the invention an information recording medium in which two substrates having the above-mentioned constitution and interposing the recording layer are combined using an adhesive, or an information recording medium of air-sandwich structure in which two disc-shaped substrates, at least one of those substrates having the above-mentioned constitution, are combined with each other by way of a ring-shaped outer spacer and a ring-shaped inner spacer so as to form a closed space surrounded by the two substrates and the two spacers.

Materials and a process for the preparation of the information recording medium according to the invention will be described hereinafter referring to the recording medium illustrated in FIG. 1.

A material of the substrate employable in the invention can be selected from any materials which have been employed as the substrates of the conventional recording media. From the viewpoint of optical characteristics, smoothness, workability, handling properties, long-term stability and manufacturing cost, preferred examples of the substrate material include glass such as tempered glass (e.g., soda-lime glass), acrylic resins such as cell-cast polymethyl methacrylate and injection-molded polymethyl methacrylate; vinyl chloride resins such as polyvinyl chloride and vinyl chloride copolymer; epoxy resins; and polycarbonate resins.

On the substrate, pregrooves may be provided, and the pregrooves can be formed on an independent layer as a pregroove layer on the substrate.

The surface of the substrate on which a recording layer is to be coated may be provided with an undercoating layer and/or an intermediate layer for the purpose of improving smoothness and adhesion to the recording layer and preventing the recording layer from being denatured. Examples of materials for such undercoating layer and/or intermediate layer include polymer materials such as polymethyl methacrylate, acrylic acid/methacrylic acid copolymer, nitrocellulose, polyethylene, polypropylene and polycarbonate; organic materials such as silane-coupling agents; and inorganic materials such as inorganic oxides (e.g., $SiO_2$, $Al_2O_3$), and inorganic fluorides (e.g., $MgF_2$).

The undercoating layer and/or the intermediate layer can be formed by dissolving or dispersing the above-mentioned material in an appropriate solvent and coating the solution or dispersion on a substrate through a known coating method such as spin coating, dip coating, or extrusion coating.

On the substrate (or the undercoating layer, or the intermediate layer) is provided a recording layer.

In the first embodiment of the present invention, the recording layer can be obtained by coating a solution containing an organic metal complex compound and a sensitizing agent for laser beam over the substrate (or the undercoating layer, or the intermediate layer), and drying the coated layer of the solution.

The organic metal complex compound employable in the invention is decomposed under heating to deposit (i.e., precipitate) in the form of a metal component contained in the compound. The organic metal complex compound is preferably soluble in an organic solvent.

The organic metal complex compound has the formula (I):

$$MmLn \qquad (I)$$

in which M is a metal atom, L is a ligand, m is an integer of 1 to 4, and n is an integer of 2 to 12.

The metal atom (M) in the above-mentioned organic metal complex compound is a metal belonging to groups of Ib, IVb, Vb, VIb, VIIb and VIII in a Periodic Table. Examples of the metal include titanium, zerconium, vanadium, chromium, molybdenum, tungsten, manganese, rhenium, iron, cobalt, nickel, ruthenium, osmium, rhodium, palladium, iridium, platinum, copper and gold.

There is no specific limitation on the ligand (L), and examples of the ligand include tertiary phosphate, carbon monooxide, straight-chain or cyclic olefin, conjugated olefin, aryl compound, heterocyclic compound, organic cyano compound, organic isonitrile compound, and organic mercapto compound. The ligand may be a compound containing one or more groups of an alkyl group, a vinyl group, an allyl group, an ethylidene group or an acyl group. Otherwise, the ligand may be an atom such as halogen, oxygen, hydrogen or nitrogen.

Examples of the organic metal complex compounds preferably employable in the invention include di-$\mu$-chloro-bis($\eta$-2-methylallyl)dipalladium(II), di-$\mu$-chloro-tetracarbonyldirhodium(I), tetrakis(triphenylphosphine)palladium(O) and di-$\mu$-chloro-bis(1,5-cyclooctadiene)diiridium(II).

The organic metal complex compound capable of depositing (precipitating) in the form of a metal component contained therein under heating is described in detail in Japanese Patent Provisional Publications No. 59(1985)-207938 and No. 60(1985)-208891.

As the sensitizing agent for laser beam (i.e., a laser beam sensitizing agent) employable in the invention, there can be mentioned a dye effectively absorbing energy of laser beam. For example, crystal violet of triphenyl methane type dye is used for an argon laser beam having a wavelength of 5,145 angstroms.

As the laser beam sensitizing agent preferably used in the invention, there can be mentioned a dye for absorbing near infrared rays (i.e., a near infrared rays-absorbing dye) dye which is conventionally used as a recording material in the known information recording medium. Examples of the near infrared rays-absorbing dye include a nitroso compound, a metal complex salt thereof, a methine dye, a cyanine dye, a merocyanine dye, a complex cyanine dye, a complex merocyanine dye, a holopolar cyanine dye, a hemicyanine dye, a styryl dye, a hemioxonol dye, a squarillium dye, a thiol nickel complex salt (including cobalt, platinum, palladium complex salt), a phthalocyanine dye, a triallylmethane dye, a triphenylmethane dye, an immonium dye, a diimmonium dye, a naphthoquinone dye and an anthraquinone dye. Those sensitizing agent for the laser beam can be employed alone or in combination.

The ratio between the organic metal complex compound and the sensitizing agent for laser beam in the recording layer is preferably in the range of 100:0.01 to 100:100 (organic metal complex compound:sensitizing agent, by weight), more preferably in the range of 100:0.05 to 100:50.

It is preferred to use a polymer and an organic solvent capable of dispersing or dissolving the polymer, organic metal complex compound and the sensitizing agent in the preparation of a coating solution for the formation of a recording layer.

The polymer is preferably soluble in an organic solvent. Examples of the polymer include polystyrene, polyvinyl chloride, polyacrylate, polycarbonate, polysulfone, polyvinylidene fluoride, polyurethane, polyamide, polyimide, silicone resin, saturated polyester, unsaturated polyester, epoxy resin and diallylphthalate resin.

In the invention, the recording layer can be generally formed on the substrate by a process comprising the steps of dissolving or dispersing the above-mentioned organic metal complex compound, laser beam sensitizing agent and polymer in a solvent to prepare a coating solution, coating the solution over the surface of the substrate (or the undercoating layer, or the intermediate layer), and drying the coated layer.

Examples of the solvents for dissolving or dispersing the organic metal complex compound, polymer and the sensitizing agent include toluene, xylene, ethyl acetate, butyl acetate, cellosolve acetate, methyl ethyl ketone, 1,2-dichloroethane, methyl isobutyl ketone, cyclohexane, tetrahydrofuran, ethyl ether and dioxane.

The organic metal complex compound as a recording material in the information recording medium of the invention is preferably contained in the recording layer in an amount of not smaller than 1% by weight. Accordingly, the amounts of the organic metal complex compoound and the polymer are adjusted in the preparation of a coating solution for a recording layer in such a manner that the amount of the organic metal complex compound is in the above-defined range.

The coating solution for the formation of a recording layer may further contain other additives such as a plasticizer and a lubricant according to the purpose.

The coating procedure can be carried out by a conventional method such as doctor knife coating, spray coating, spin coating, dip coating, roll coating and screen printing.

As mentioned hereinbefore, in the recording medium of the invention, each of the organic metal complex compound and the laser beam sensitizing agent may be contained in different layers (the second embodiment). That is, as shown in FIGS. 5 and 6, the information recording medium may comprise a layer containing an organic metal complex compound and a layer containing a sensitizing agent for laser beam.

In the information recording medium of the invention, any layer of the recording layer and the layer of a sensitizing agent for laser beam (also referred to hereinafter as "a sensitizing agent layer for laser beam" or simply as "a sensitizing agent layer") can be take the upper side as described below. In detail, on the substrate may be laminated (superposed) the recording layer and the sensitizing agent layer in this order, otherwise, on the substrate may be laminated (superposed) the sensitizing agent layer and the recording layer in this order.

Materials and a process for the preparation of an information recording medium according to the invention will be described hereinafter referring to the above-mentioned constitution of the latter case (i.e., constitution shown in FIG. 4).

Typical examples of the sensitizing agent layer include a layer made of only a laser beam sensitizing material and a layer comprising a laser beam sensitizing agent dispersed in a binder such as a polymer.

The sensitizing agent layer using the aforementioned laser beam sensitizing dye can be prepared by dissolving the sensitizing dye (and a binder, if desired) in an appropriate solvent to prepare a coating solution, coating the solution over the surface of the substrate (or recording layer), and drying the coated layer.

Examples of the binder include natural organic polymer materials such as gelatin, cellulose derivative, dextran, rosin and rubber; and synthetic organic polymer materials such as hydrocarbon resins (e.g., polyethylene, polypropylene, polystyrene and polyisobutylene), vinyl resins (e.g., polyvinyl chloride, polyvinylidene chloride and polyvinyl chloride/polyvinyl acetate copolymer), acrylic resins (e.g., methyl polyacrylate and methyl polymethacrylate), and precondensates of thermosetting resins (e.g., polyvinyl alcohol, chlorinated polyethylene, epoxy resin, butyral resin, rubber derivative and phenol formaldehyde resin).

Examples of the solvents for the preparation of the coating solution include solvents capable of dissolving or dispersing a polymer blend and a laser beam sensitizing agent such as toluene, xylene, ethyl acetate, butyl acetate, cellosolve acetate, methyl ethyl ketone, dichloromethane, 1,2-dichloroethane, dimethylformamide, methyl isobutyl ketone, cyclohexanone, cyclohexane, tetrahydrofuran, ethyl ether, dioxane, ethanol, n-propanol, isopropanol, and n-butanol; and mixtures thereof. The coating solution for the formation of the sensitizing agent layer may further contain other additives such as an antioxidant, an UV-absorbent, a plasticizer and a lubricant according to the purpose.

The coating procedure can be carried out by a conventional method such as spray coating, spin coating, dip coating, roll coating, blade coating, doctor roll coating and screen printing.

In the case of using a combination of a laser beam sensitizing dye and a binder as a material of the sensitizing agent layer, the ratio between the laser beam sensitizing dye and the binder is generally in the range of 100:0.1 to 100:100 (laser beam sensitizing dye:binder, by weight), preferably in the range of 100:1 to 100:50. The thickness of the sensitizing agent layer is generally in the range of 0.01 to 10 μm, preferably in the range of 0.02 to 1 μm. The sensitizing agent layer may be provided one or both surfaces of the recording layer.

The sensitizing agent layer can be made of a metal or a semi-metal showing a high absorption for laser beam. The metals or semi-metals can be employed independently or in the form of a composition. Otherwise, the metal or semi-metal can be employed in combination with its oxide, halide or sulfide.

Examples of the metals or semi-metals employable as the laser beam sensitizing agent include Mg, Se, Y, Ti, Zr, Hf, V, Nb, Ta, Cr, Mo, W, Mn, Re, Fe, Co, Ni, Ru, Rh, Pd, Ir, Pt, Cu, Ag, Au, Zn, Cd, Al, Ga, In, Si, Ge, Te, Pb, Po, Sn and Bi. These materials can be employed independently or in combination. Alloys thereof can be also employed in the invention.

In the case of using the above-mentioned metals or semi-metals as the laser beam sensitizing agent, the layer of the sensitizing agent can be formed on the substrate (or recording layer, or the undercoating layer provided on the substrate) by a known method such as a method of deposition, sputtering or ion plating. In this case, the thickness of the sensitizing agent layer is generally in the range of 100 to 3,000 angstroms, preferably in the range of 300 to 1,000 angstroms.

The formation of a recording layer containing the organic metal complex compound can be done in the same manner as described hereinbefore in the formation of a recording layer containing both of the organic metal complex compound and the laser beam sensitizing agent.

The recording layer may be in the form of a single layer or plural layers, and in any case, the thickness of the recording layer is generally in the range of 0.01 to 40 μm, preferably in the range of 0.02 to 5 μm.

On the recording layer (or the sensitizing agent layer for laser beam in the case that such layer is provided on the recording layer, namely on the opposite side of the substrate side) may be provided a laser beam reflecting layer (referred to hereinafter simply as "reflecting layer") for the purpose of increasing the S/N ratio in the reproduction procedure of information or improving a sensitivity in the recording (writing) procedure. In the case of a recording medium having such structure, recording or reproduction of information is performed by irradiating the recording layer with laser beam from the substrate side. The reflecting layer may be provided between the substrate (or undercoating layer) and the sensitizing agent layer (or recording layer in the case that the sensitizing agent layer is provided on the recording layer). In this case, recording or reproduction of information is performed by irradiating the recording layer with laser beam from the upper side of the recording medium (i.e., opposite side of the substrate side).

The laser beam reflecting layer is essentially composed of a light-reflecting material. The light-reflecting material has a high reflectance for the laser beam. Examples of the light-reflecting material include metals and semi-metals such as Mg, Se, Y, Ti, Zr, Hf, V, Nb, Ta, Cr, Mo, W, Mn, Re, Fe, Co, Ni, Ru, Rh, Pd, Ir, Pt, Cu, Ag, Au, Zn, Cd, Al, Ga, In, Si, Ge, Te, Pb, Po, Sn and Bi. Preferred are Al, Cr and Ni. These materials can be employed alone or in combination. Alloys thereof can be also employed in the invention. When the reflecting layer is prepared by using a metal or a semi-metal, the metal or semi-metal has higher reflectance than a metal or a semi-metal used for the preparation of the aforementioned sensitizing agent layer. In this case, both of the reflecting layer and the sensitizing agent layer are arranged on the same side with respect to the recording layer.

The reflecting layer can be formed on any layer of the recording layer, substrate or the undercoating layer by using the light-reflecting material according to a known method such as deposition, sputtering or ion plating. The thickness of the reflecting layer is generally in the range of 100 to 3,000 angstroms.

In the case of providing the sensitizing agent layer and the recording layer on only one surface of the substrate and performing recording and reproduction of information from the substrate side, the reflecting layer may be provided on the surface of the recording layer not facing the substrate.

A protective layer may be further provided on the surface of the recording layer or the reflecting layer not facing the substrate (i.e., exposed surface side) to physically or chemically protect the recording layer. The protective layer can be also provided on the surface of the substrate where the recording layer is not provided to enhance a resistance to damage or humidity. As a material of the protective layer, there can be mentioned inorganic materials such as SiO, $SiO_2$, $MgF_2$ and $SnO_2$; and organic materials such as thermoplastic resins, thermosetting resins and UV-curable resins.

The protective layer can be formed on the recording layer (or the sensitizing agent layer, or the reflecting layer) and/or the substrate by laminating a plastic film having been prepared by extrusion processing on any of those layers and/or the substrate by way of an adhesive layer. Otherwise, a method of vacuum deposition, sputtering or coating can be also applied to form the protective layer. In the case of using the thermoplastic resin or the thermosetting resin, the resin is dissolved in an appropriate solvent to prepare a coating solution, and the solution is coated over the recording layer and/or the substrate. The coated layer is then dried to form a protective layer. In the case of using the UV-curable resin, a solution of the resin in an appropriate solvent is coated over the recording layer and/or the substrate, and the coated layer of the solution is irradiated with ultraviolet rays to cure the layer so as to form a protective layer. In any case, the coating solution may further contain a variety of additives such as an antistatic agent, an antioxidant and an UV-absorbent according to the purpose. The thickness of the protective layer is generally in the range of 0.1 to 100 μm.

Processes for recording (i.e., writing) information and reproducing (i.e., reading out) the recorded information using the recording medium of the present invention will be described hereinafter, referring to the recording medium comprising a substrate and a recording layer which is shown in FIG. 1.

In the recording of information, a semiconductor laser giving infrared rays such as Ga-As laser can be utilized. A laser beam converged by a known method is irradiated on the substrate side of the recording medium. Under irradiation, the laser beam sensitizing agent in the irradiated area of the recording layer instantaneously absorbs the beam energy to generate a heat. By the generated heat, the organic metal complex compound which is in contact with the sensitizing agent in the recording layer is decomposed to give deposition (precipitation or separation out) of a metal component, whereby an alteration of optical characteristics is given between the irradiated area and the non-irradiated area in the recording layer. Thus, recording of information is done.

In the present invention, it should be understood that the express of "decomposition of organic metal complex compound" means a phenomenon of deposition (precipitation or separation out) of metal atoms from the organic metal complex compound, and does not specifically mean decomposition of the ligand contained in the organic metal complex compound.

Reproduction (reading out) of the recorded information from the recording medium can be carried out in the same manner as that conventionally used in the read-out of the information. In detail, a laser beam for reproducing information is irradiated on the recording layer side or the substrate side of the recording medium to measure a light reflectance of the reflected light. On the basis of the difference of the reflectance between the metal-deposited area and the unchanged area of the recording layer, the recorded information can be reproduced. When the reflecting layer is provided on the surface of the recording layer, the difference of the light reflectance becomes more prominent to enhance the S/N ratio for reproduction. On the contrary, when the reflecting layer is not provided on the recording layer, a light transmittance of the transmitted light of the laser beam is measured, and on the basis of the difference of the transmittance between the metal-deposited area and the unchanged area of the recording layer, reproduction of the recorded information can be made.

The above-described recording information is based on the deposition of the metal component, and accordingly read-out of the recorded information can be carried out using an electromagnetic reading means utilizing electric or magnetic properties of a metal as well as an optical means.

Examples of the present invention are given below.

EXAMPLE 1

2.3 g. of di-μ-chloro-bis(η-2-methylallyl)dipalladium-(II), 5.0 g. of polycarbonate and 100 mg. of crystal violet were dissolved in 66.4 g. of chloroform to prepare a coating solution.

The obtained solution was coated over a glass substrate by means of a spinner coating machine to give a coated layer of the solution, and the coated layer was dried at a temperature of 100° C. for 5 minutes to form a recording layer having dry thickness of 15 μm on the glass substrate.

The recording layer was then irradiated with a converged argon ion laser beam (beam wavelength: 5,145 angstroms, beam diameter on the surface of the recording layer: 6 μm) at an output level of 60 mW (laser power on the surface of the recording layer) by modulating a pulse length to 1 μsec. by means of an AO modulator.

As a result of observation of the surface of the recording layer by the use of an optical microscope according to a reflecting method, it was confirmed that deposition of the metal component was observed in the area irradiated with laser beam to indicate that the information was recorded

COMPARISON EXAMPLE 1

Using the same coating solution as that of Example 1 except for not incorporating crystal violet, a recording layer having dry thickness of 14 μm was formed on a glass substrate in the same manner as in Example 1.

The recording layer was then irradiated with a converged argon ion laser beam (beam wavelength: 5,145 angstroms, beam diameter on the surface of the recording layer: 6 μm) at an output level of 400 mW (laser power on the surface of the recording layer) by modulating a pulse length to 1 μsec. by means of an AO modulator.

The surface of the recording layer was observed by the use of an optical microscope according to a reflecting method, but any metal component did not deposit on the irradiated area with the laser beam.

EXAMPLE 2

On a soda-lime glass substrate of 1.6 mm thick was deposited aluminum through vacuum deposition to form a layer of a sensitizing agent for laser beam (aluminum deposited film) having thickness of 1,000 angstroms on the substrate.

Separately, 2.3 g. of di-μ-chloro-bis(η-2-methylallyl)-dipalladium(II) and 5.0 g. of polycarbonate were dissolved in 66.4 g. of chloroform to prepare a coating solution.

The obtained solution was coated over the aboveobtained aluminum deposited film on the soda-lime glass substrate by the use of a spinner coating machine, and the coated layer was dried at 100° C. for 5 minutes to form a recording layer having dry thickness of 13 μm on the aluminum deposited film.

The recording layer was then irradiated with a converged argon ion laser beam in the same manner as in Example 1. In this irradiation procedure, the laser beam was irradiated from the recording layer side (opposite side of the glass substrate side) of the recording medium.

As a result of observation of the surface of the recording layer by the use of an optical microscope according to a reflecting method, it was confirmed that deposition of the metal component was observed in the area irradiated with laser beam to indicate that the information was recorded.

EXAMPLE 3

An aluminum deposited film (i.e., a layer of sensitizing agent for laser beam) having thickness of 1,000 angstroms was formed on a sode-lime glass substrate in the same manner as in Example 2.

Using the same coating solution as that of Example 1, a recording layer having dry thickness of 15 μm was formed on the aluminum deposited film having been provided on the soda-lime glass substrate in the same manner as in Example 2.

The recording layer was then irradiated with a converged argon ion laser beam in the same manner as in Example 1. In this irradiation procedure, the laser beam was irradiated from the recording layer side (opposite side of the glass substrate side) of the recording medium.

As a result of observation of the surface of the recording layer by the use of an optical microscope according to a reflecting method, it was confirmed that deposition of the metal component was observed in the area irradiated with laser beam to indicate that the information was recorded.

We claim:

1. A process for recording information on a recording layer arranged on a substrate, said recording layer containing an organic metal complex compound having the formula:

$$MmLn$$

where M is a metal atom belonging to one of groups Ib, IVb, Vb, VIb, VIIb, or VIII of the Periodic Table, L is a ligand, m is an integer from 1 to 4, and n is an integer from 2 to 12, and a sensitizing dye capable of absorbing near infrared rays, by irradiating the recording layer with a laser beam to deposit a metal component in the recording layer at the irradiated area by decomposition of the organic metal complex compound.

2. The process for recording information as claimed in claim 1, wherein said metal atom is selected from the group consisting of titanium, zirconium, vanadium, chromium, molybdenum, tungsten, manganese, rhenium, iron, cobalt, nickel, ruthenium, osmium, rhodium, palladium, iridium, platinum, copper, and gold.

3. The process for recording information as claimed in claim 1, wherein said organic metal complex compound is selected from the group consisting of di-μ-chloro-bis (η-2-methylallyl)-dipalladium (II), di-μ-chloro-tetracarbonyl dirhodium (I), tetrakis (triphenylphosphine) palladium (O), and di-μ-chloro-bis (1, 5-cyclooctadiene) diiridium (II).

4. The process for recording information as claimed in claim 1, wherein said dye is selected from the group consisting of a nitroso compound, a metal complex salt thereof, a methine dye, a cyanine dye, a merocyanine dye, a complex cyanine dye, a complex merocyanine dye, a holopolar cyanine dye, a hemicyanine dye, a styryl dye, a hemioxanol dye, a squarillium dye, a thiol nickel complex salt, a phthalocyanine dye, a triallylmethane dye, a triphenylmethane dye, an immonium dye, a diimmonium dye, a napthoquinone dye, and an anthraquinone dye.

5. A process for recording information on a recording layer arranged in contact with a layer containing a sensitizing agent for a laser beam and a substrate, said recording layer containing an organic metal complex compound having the formula:

$$MmLn$$

wherein M is a metal atom belonging to one of groups Ib, IVb, Vb, VIb, VIIb, or VIII of the Periodic Table, L is a ligand, m is an integer from 1 to 4, and n is an integer from 2 to 12, by irradiating the recording layer with a laser beam to deposit a metal component in the recording layer at the irradiated area by decomposition of the organic metal complex compound.

6. The process for recording information as claimed in claim 5, wherein said sensitizing agent for laser beam is composed of a metal or a semimetal having laser beam absorption characteristics.

7. The process for recording information as claimed in claim 5, wherein said organic metal complex compound is selected from the group consisting of di-μ-chloro-bis (η-2-methylallyl)-dipalladium (II), di-μ-chlorotetracarbonyl dirhodium (I), tetrakis (triphenylphosphine) palladium (O), and di-μ-chloro-bis (1,5-ccyclooctadiene) diiridium (II).

8. The process for recording information as claimed in claim 5, wherein said metal atom is selected from the group consisting of titanium, zirconium, vanadium, chromium, molybdenum, tungsten, manganese, rhenium, iron, cobalt, nickel, ruthenium, osmium, rhodium, palladium, iridium, platinum, copper and gold.

9. A process for recording information on a recording layer arranged on a substrate, said recording layer containing an organic metal complex compound which is selected from the group consisting of di-μ-chloro-bis (η-2-methylallyl)-dipalladium (II), di-μ-chloro-tetracarbonyl dirhodium (I), tetrakis (triphenylphosphine) palladium (O), and di-μ-chloro-bis (1, 5-cyclooctadiene) diiridium (II) and a sensitizing agent for a laser beam, by irradiating the recording layer with a laser beam to deposit a metal component in the recording layer at the irradiated area by decomposition of the organic metal complex compound.

* * * * *